US010640844B2

(12) United States Patent
Lu et al.

(10) Patent No.: US 10,640,844 B2
(45) **Date of Patent: *May 5, 2020**

(54) KIND OF UNIFORM STRENGTHENING METHODS OF TURBINE BLADE SUBJECTED TO VARIED SQUARE-SPOT LASER SHOCK PEENING WITH STAGGER MULTIPLE-LAYER

(71) Applicant: JIANGSU UNIVERSITY, Jiangsu (CN)

(72) Inventors: Jinzhong Lu, Jiangsu (CN); Yue Liu, Jiangsu (CN); Kaiyu Luo, Jiangsu (CN); Zhilong Wang, Jiangsu (CN)

(73) Assignee: JIANGSU UNIVERSITY (CN)

( * ) Notice: Subject to any disclaimer, the term of this patent is extended or adjusted under 35 U.S.C. 154(b) by 286 days.

This patent is subject to a terminal disclaimer.

(21) Appl. No.: 15/308,596

(22) PCT Filed: Sep. 9, 2015

(86) PCT No.: PCT/CN2015/089214

§ 371 (c)(1),
(2) Date: May 17, 2018

(87) PCT Pub. No.: WO2017/012184

PCT Pub. Date: Jan. 26, 2017

(65) Prior Publication Data

US 2018/0258509 A1 Sep. 13, 2018

(30) Foreign Application Priority Data

Jul. 21, 2015 (CN) ..... 2015 1 0426730

(51) Int. Cl.

| | |
|---|---|
| ***C21D 10/00*** | (2006.01) |
| ***F01D 5/28*** | (2006.01) |
| *C21D 1/09* | (2006.01) |

(52) U.S. Cl.

CPC ..... *C21D 10/005* (2013.01); *F01D 5/286* (2013.01); *C21D 1/09* (2013.01); *C21D 10/00* (2013.01);

(Continued)

(58) Field of Classification Search

CPC ..... C21D 10/00; C21D 10/005; F01D 5/286

(Continued)

(56) References Cited

U.S. PATENT DOCUMENTS 10,512,987 B2 * 12/2019 Lu ..... B23K 26/0732
2004/0224179 A1 * 11/2004 Sokol ..... C21D 10/005 428/610

OTHER PUBLICATIONS

Dane et al., "Recent progress in laser technology for industrial laser peening," 4th International Conference on Laser Peening, Madrid, Spain, May 6, 2013 (35 pgs).

(Continued)

*Primary Examiner* — Weiping Zhu
(74) *Attorney, Agent, or Firm* — Hayes Soloway PC

(57) ABSTRACT

A method for laser shock peening (LSP) to uniformly strengthen metallic components uses varied square-spot LSP with stagger multiple-layer. Each layer is subjected to square-spot LSP treatment, without overlapping. The length of square-spot in the first layer is larger than those in the second layer and third layers, and the length of square-spot in the second layer is equal to that in the third layer. The first layer treated by LSP is used to reduce deeper localized compressive residual stress, and the second and third layers imparted by square-spot LSP with staggered distance are used to eliminate of the boundary effect and decrease surface roughness.

14 Claims, 3 Drawing Sheets

(52) U.S. Cl.
CPC ..... *C21D 2221/00* (2013.01); *F05D 2230/90* (2013.01); *F05D 2300/516* (2013.01)

(58) Field of Classification Search
USPC ..... 148/525
See application file for complete search history.

(56) References Cited

OTHER PUBLICATIONS

Peyre et al., "Surface modifications induced in 316L steel by laser peening and shot-peening. Influence on pitting corrosion resistance," Material Science and Engineering A280, 2000, pp. 294-302 (9 pgs).
Sokol et al., "Applications of Laser Peening to Titanium Alloys," ASME/JSME 2004 Pressure Vessels and Piping Division Conference, San Diego, CA, Jul. 25-29, 2004 (4 pgs).
Tenaglia et al., "Preventing Fatigue Failures with Laser Peening," The AMPTIAC Quarterly, vol. 7, No. 2 (6 pgs).

* cited by examiner (a) (b)

(a)

(b)

KIND OF UNIFORM STRENGTHENING METHODS OF TURBINE BLADE SUBJECTED TO VARIED SQUARE-SPOT LASER SHOCK PEENING WITH STAGGER MULTIPLE-LAYER

BACKGROUND OF THE INVENTION

1. Field of the Invention

The present invention relates to a kind of uniform strengthening methods of turbine engine blade subjected to varied square-spot LSP with stagger multiple-layer which may be utilized for homogeneous strengthening at the edge of turbine blades, such as the steam turbine blade in low pressure transition zone, the gas turbine blade, the turbine blade of aero-engine.

2. Background of the Invention

Laser shock peening (LSP) is a new surface strengthening technology which uses laser-induced, high-energy shock wave to produce severe plastic deformation, and then induce compressive residual stress and refine grain on the impacted area of metallic components. Hence, LSP can significantly improve the surface properties of metal parts. Compared with other techniques, LSP has four notably characteristics of high pressure (GPa-TPa), high energy (peak power of GW), ultra-fast (tens of a nanosecond) and ultra-high strain rate (reach $10^7$ $s^{-1}$). The compressive residual stress layer with a thickness of more than 1 mm induced by LSP can effectively eliminate the stress concentration and inhibit the initiation and propagation of the crack, which can also improve the fatigue life of metallic parts and the ability to resist corrosion and wear. The spot shape is also an important factor to affect the strengthening effect. The square spot where energy is uniformly distributed generates a plane shock wave with uniform strength, leading to the better uniform compressive residual stress, the better strengthening effect, and the smaller roughness by the "surface hardening" effect. A large number of researches have shown that LSP is an effective method for prolonging the time of crack initiation and improvement in the fatigue life of the metallic components. LSP is also one of the advanced manufacturing methods at extreme conditions, and has incomparable advantages and significant technological superiority.

In December 1994, sponsored by the United States Department of Defense Manufacturing Technology (ManTech) Research Program, the United States General Electric (GE) and Laser Shock Processing Technology (LSPT) Company developed LSP technology in cooperation, in order to improve the durability of fan blades, and reduce blade's sensitivity to external damage.

Beginning in 2002, American Metal Improvement Company (MIC) commercialized LSP technology to strengthen aircraft blades which were from Boeing, Airbus, Gulf Stream Company. Furthermore, LSP has been extended to the surface treatment of turbine blades, which achieves significant strengthening effect and economic benefits.

At the beginning of this century, Peyre, a french scientist, tried to apply the LSP technology to the pitting corrosion resistance of austenitic stainless steel. The result showed that the pitting corrosion resistance of AISI 316 stainless steel imparted by LSP is significantly improved in 0.5 M NaCl solution.

Surface morphology, residual stress of the metallic material and the depth of grain refinement have a significant effect on the quality and performance of the metallic components, directly affecting the contact strength, corrosion resistance, wear resistance, sealing and anti-fatigue properties of the metallic components. When the component surface with a large area is impacted by overlapping LSP impacts, especially for the curved surface, due to the vaporization and explosion of ultra-strong plasma in the ultra-short time, the absorbing layer is prone to warping and then exfoliation, resulting in the erosion and ablation of surface layer. Therefore, four following common problems must be solved when the LSP technology is applied to improve the corrosion resistance of metallic materials: (1) The uniformity in the residual stress field and the surface micro-morphology caused by massive LSP treatment, (2) the consistency of strengthening effect on the top surface with varied thicknesses along the expanding length direction, (3) the LSP criterion of the distorted surface with varying curvature, and (4) the challenge in warping and then exfoliation of the absorbing layer caused by massive LSP impacts.

SUMMARY OF THE INVENTION

The present invention includes a kind of uniformly strengthening methods by the varied square-spot LSP with stagger multiple-layer. The method includes three stagger layers. There are three layers during varied square-spot LSP with stagger multiple-layer. During each layer subjected to square-spot LSP treatment, both adjacent square-spots are next to each other without the overlapping region. The length of square-spot in the first layer is set as a, and those in the second and third layers are set to a/2. The first layer treated by LSP is used to reduce deeper localized compressive residual stress, and the second and third layers imparted by square-spot LSP with staggered distance are used to eliminate of the boundary effect and decrease surface roughness. Moreover, the present invention includes a special absorbing layer which covers isometric grids and the grid size according to the square spot, and these isometric grids can be used to accurately position. In summary, the present invention can be used to produce uniform compressive residual stress layer and effectively eliminate the boundary effect, reduce the surface roughness, refine the coarse grain in the surface layer of turbine blades.

Advantages

The present invention can be used to strengthen the edge of metallic blades, such as steam turbine blade in low pressure transition zone, gas turbine blade and turbine blade of aero-engine. The method can be used to increase the low cycle fatigue (LCF) life and decrease crack growth rate to acceptable levels, effectively eliminating the boundary effect, reducing the surface roughness, refining the coarse grains in the surface layer, and obtaining the uniform strengthening effect at the edge of metallic blades. Furthermore, under the effect of the same energy density, the large square-spot in the first layer is used to generate the deeper residual stress which the smaller square-spots in the second and third layers and staggered multiple-layer are applied to eliminate the boundary effect and achieve the smoother surface.

BRIEF DESCRIPTION OF THE DRAWINGS

The foregoing aspects and other features of the invention are explained in the following description, taken in connection with the accompanying drawings where:

FIG. 2(*a*) is an illustration of the first layer with latticed absorbing layer. FIG. 2(*b*) is an illustration of the second (third) layer with latticed absorbing layer

FIG. 5*a* and FIG. 5*b* are the metallographic structures subjected to varied square-spot laser shock peening with stagger multiple-layer and one laser shock peening impact, respectively.

FIG. 1: 1 laser beam, 2 laser control device, 3 square-spot, 4 confining layer, 5 latticed absorbing layer, 6 metallic material, 7 five-axis workbench, 8 numerical control system.

DETAILED DESCRIPTION OF THE INVENTION

Figure 1:
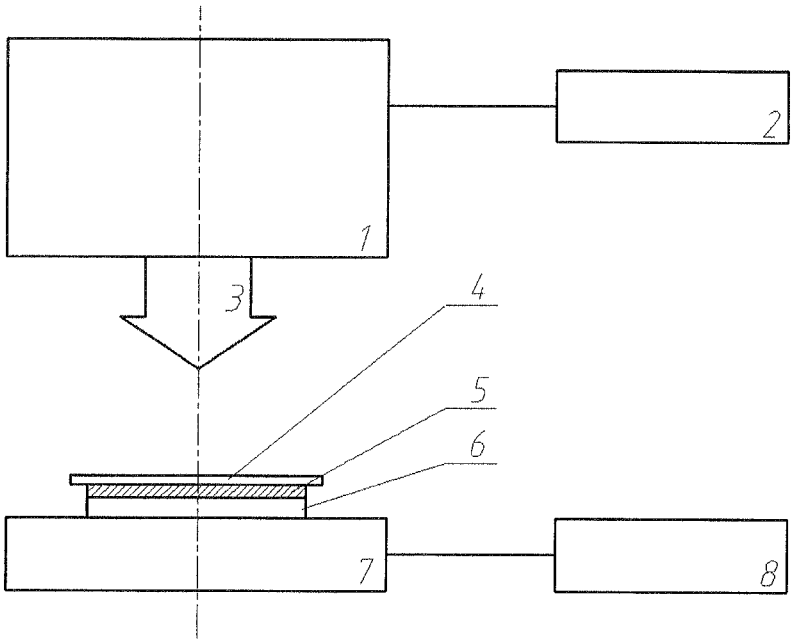
FIG. 1 is a schematic illustration of the varied square-spot LSP device with stagger multiple-layer.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

In accordance with a preferred embodiment of the present invention, FIG. 1 illustrates that the method includes:

Mounting the metallic material 6 on a five-axis workbench 7 and covering the latticed absorbing layer 5 onto the surface of the metallic material 6 and the grid length is a.

Using a laser control device 2 to set the laser output power and the laser parameters, and modulate the round laser spot into square spot whose length is also a. Subsequently, both adjacent square-spots are next to each other without the overlapping region.

Using a numerical control system 8 to adjust the five-axis workbench 7, make the laser beam 1 to match the corner of the latticed absorbing layer 5, and make this point A as the starting position in the first layer subjected to LSP. The X- and Y-direction of the latticed absorbing layer 5 align with those of the workbench, respectively.

Taking running water as the confining layer 4, turning on the laser generation device and operating the numerical system 8 to control both movement and rotation of the five-axis workbench 7, so as to the surface of metallic material 6 is treated by LSP in a row-by-row way in the first layer.

Using a laser control device 2 to set the laser output power and the laser spot parameters, and modulate the round laser spot into square spot whose length is also a/2. Subsequently, both adjacent square-spots are next to each other without the overlapping region, and other parameters keep unchanged.

Using the numerical control system 8 to adjust the five-axis workbench 7, so as to make the laser beam 1 match the corner of the latticed absorbing layer 5 and then the laser beam 1 is shift by a distance of a/3 toward right and toward down, respectively. Regard this new point B as the starting position in the second layer subjected to LSP. The X- and Y-direction of the latticed absorbing layer 5 align with those of the workbench.

Taking running water as the confining layer 4, turning on the laser generation device and operate the numerical system 8 to control both movement and rotation of the five-axis workbench 7, so as to the surface of metallic material 6 is treated by LSP in a row-by-row way in the second layer.

Using the numerical control system 8 to adjust the five-axis workbench 7, so as to make the laser beam 1 and match the corner of the latticed absorbing layer 5 and then the laser beam 1 is shift by a distance of a/3 toward right and toward down, respectively. Regard this new point C as the starting position in the third layer subjected to LSP. The X- and Y-direction of the latticed absorbing layer 5 align with those of the workbench, a is the size of the square-spot. LSP process parameters are in line with those in the second LSP process.

Taking running water as the confining layer 4, turning on the laser generation device and operating the numerical system 8 to control both movement and rotation of the five-axis workbench 7, so as to the surface of metallic material 6 is treated by LSP in a row-by-row way in the third layer.

Figure 2:
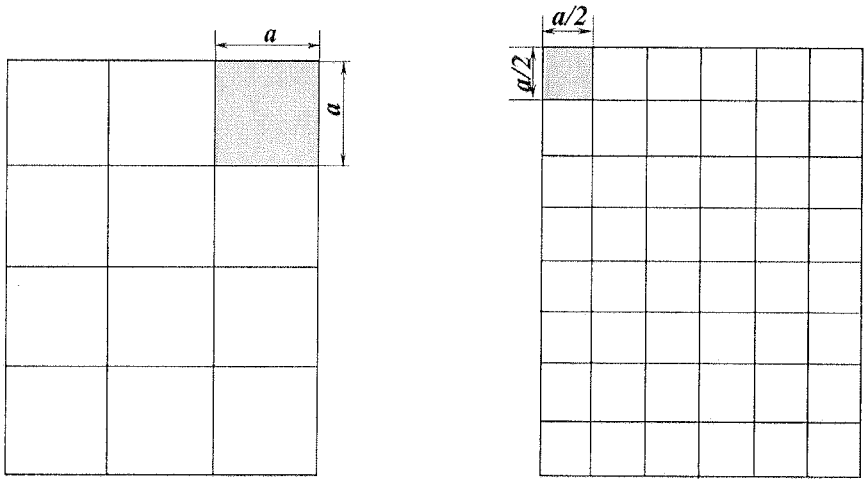
FIG. 2 is an illustration of the latticed absorbing layer from the front view. a/2 and a are the grid length in accordance with an exemplary embodiment in the present invention.

The laser beam used for LSP in the present invention is a square spot, the length of the spot is 2-8 mm, the laser frequency is 1-5 Hz, the pulse width is 8-30 ns and the pulse energy is 3-15 J. The latticed absorbing layer is designed as an adjacent square, as illustrated in FIG. 2.

Figure 3:
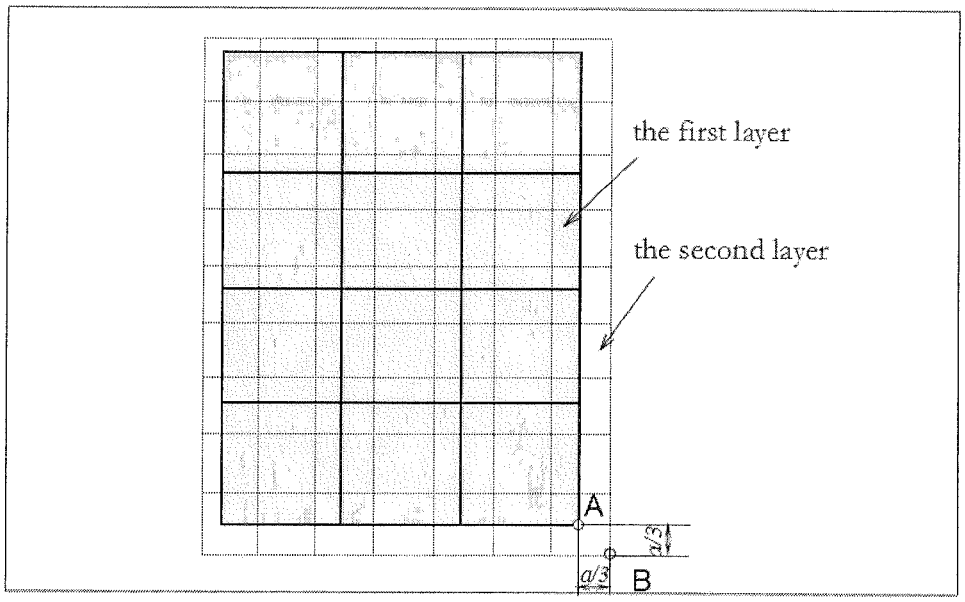
FIG. 3 is a schematic illustration of square-spot arrangement in the LSPed region. Point A is the starting point of massive LSP treatment in the first layer, Point B is the starting point of massive LSP treatment in the second layer, and Point C is the starting point of massive LSP treatment in the third layer.
Figure 3:
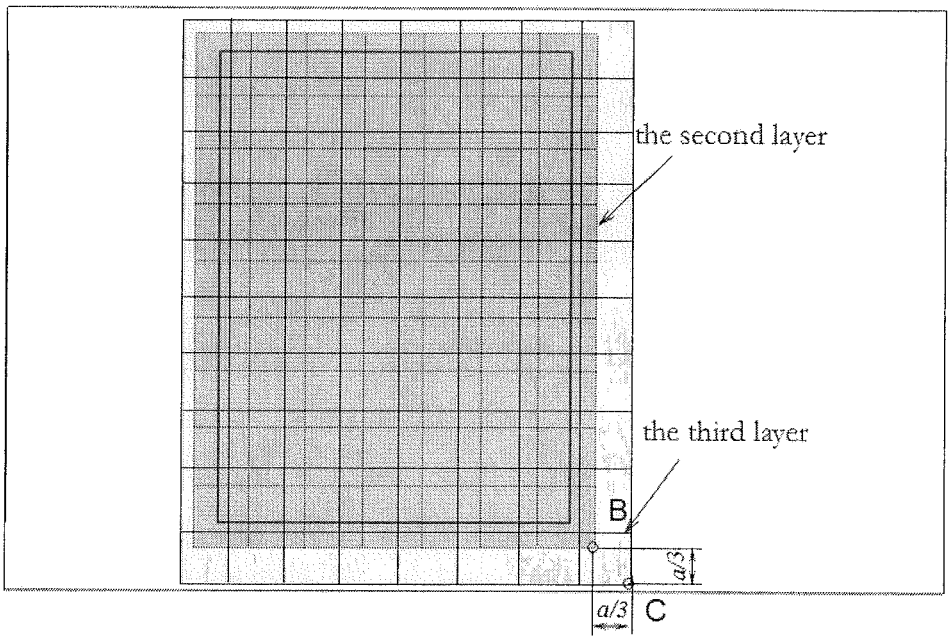

Referring to FIG. 3, both adjacent square-spots are next to each other without the overlapping region in each layer. There are three layers during varied square-spot LSP with stagger multiple-layer. During each layer subjected to square-spot LSP treatment, both adjacent square-spots are next to each other without the overlapping region. The length of square-spot in the first layer is larger than those in the second layer and third layer, and the length of square-spot in the second layer is equal to that in the third layer. In addition, from the starting point of the current layer to the starting point of the former layer subjected to LSP, the deviations are a/3 in both X- and Y-directions. If the laser energy density is more than the withstanding threshold of the metallic material, the damage will take place on the surface, and this threshold depends on the physics properties of a given metallic material.

What the present invention adopted the preparation method of the absorbing layer is that: mix organic silica gel GN-521, cyanoacrylate and methyl tert-butyl ether at the mass ratio of 5:3:2 and allow them to react at 70-90° C. for 10 min~30 min. Suppress a terrace die according to the length of square spot on the front of the absorbing layer, and the back is a plane. The absorbing layer with a thickness of 0.8-1 mm form finally after being cooled.

The reduction design of laser spot size can be explained by the calculation formula of laser power density:

$$I = \frac{4\alpha E}{\pi D_{\tau}^{2}};$$

Figure 4:
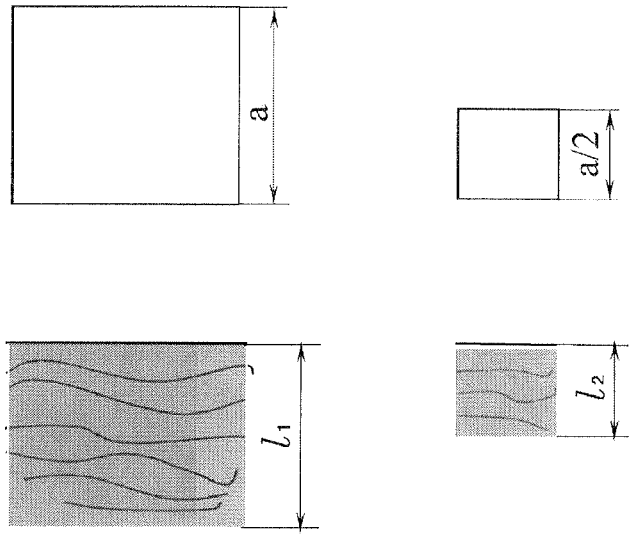
FIG. 4 is a schematic illustration of residual stress layer induced by square-spot LSP treatment with lengths of a and a/2, respectively. Accordingly, $l_1$ and $l_2$ are the depth of residual stress, respectively.
Figure 5:
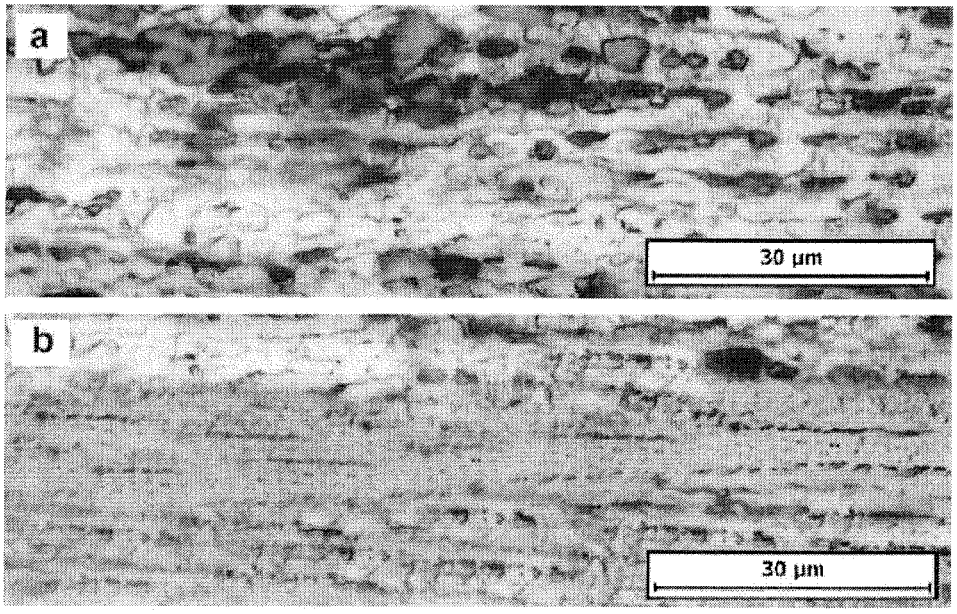
FIG. 5 is a comparison chart of metallographic structures.

In this formula, E is the pulse energy (J), τ is the pulse width (ns) and D is the spot diameter (cm), α=0.8. Under the same laser energy density, as illustrated in FIG. 4, the larger square-spot is used to generate the deeper plastic deformation, resulting in a thicker compressive residual stress and grain refinement layer, and the smaller square-spot is used to generate smooth surface and eliminate the boundary effect. The back of the latticed absorbing layer is sticky and can be adsorbed on the smooth surface of the metallic material.

The present invention has been illustrated in detail in the form of a LY2 aluminum alloy plate but is applicable to other metallic plates. While the preferred embodiment of the present invention has been described fully in order to explain its principles, it is understood that various strengthening may be made to the preferred embodiment without departing from the scope of the invention as set forth in the appended claims.

What is claimed is:

1. A method for uniformly strengthening a metallic material, said method comprising the steps of:

(1) mounting the metallic material on a five-axis workbench and applying a latticed absorbing layer having a grid length a onto a surface of the metallic material;

(2) using a laser, modulating a round laser spot into a square spot having a length a onto the latticed absorbing surface;

(3) repeating step (2), directing round laser spots modulated to square-spots next to one another without overlapping regions;

(4) using a numerical control system to adjust the five-axis workbench, and directing the laser beam to match a corner of the latticed absorbing layer, making this point "A" as a starting position in a first layer, wherein the X- and Y-directions of the latticed absorbing layer align with those of the workbench, respectively;

(5) using running water as a confining layer, activating the laser generation device and operating the numerical system to control both movement and rotation of the five-axis workbench, and treating the surface of metallic material by Laser Shock Peening (LSP) row-by-row in the first layer;

(6) using a laser control device to set the laser output power and the laser spot parameters, modulating the round laser spot into a square spot whose length is a/2, wherein adjacent square-spots are next to each other without an overlapping region;

(7) using the numerical control system to adjust the five-axis workbench, and directing the laser beam to match a corner of the latticed absorbing layer, and shifting the laser beam by a distance of a/3 toward right and toward down, respectively, whereby to create a new point B as a starting position in a second layer subjected to LSP, and aligning the X- and Y-direction of the latticed absorbing layer to align with that of the workbench;

(8) using running water as a confining layer, activating the laser generation device and operating the numerical system to control both movement and rotation of the five-axis workbench, and treating the surface of metallic material by LSP row-by-row in the second layer;

(9) using the numerical control system to adjust the five-axis workbench, and directing the laser beam to match a corner of the latticed absorbing layer, and shifting the laser beam by a distance of a/3 toward right and toward down, respectively, whereby to create a new point C as a starting position in a third layer subjected to LSP, and aligning the X- and Y-direction of the latticed absorbing layer with those of the workbench, wherein a is the size of the square-spot, and the LSP process parameters are in line with those of the second LSP treatment; and

(10) using running water as the confining layer, activating the laser generation device and operating the numerical system to control both movement and rotation of the five-axis workbench, and treating the surface of metallic material by LSP row-by-row in the third layer.

2. The method of claim 1, wherein the laser beam used for LSP projects a square spot having a length of 2-8 mm, the laser frequency is 1-5 Hz, the pulse width is 8-30 ns, and the pulse energy is 3-15 J.

3. The method of claim 1 wherein a unit grid of lattice absorbing layer has the same size as the laser spot, and a back surface of the absorbing layer is sticky to adhere to the smooth surface of metallic material.

4. The method of claim 1, wherein the latticed absorbing layer is formed by mixing organic silica gel GN-521, cyanoacrylate and methyl tert-butyl ether at the mass ratio of 5:3:2 and allowing the mixture to react at 70-90° C. for 10 min-30 min.

5. The method of claim 4, wherein the absorbing layer has a thickness of 0.8-1 mm after cooling.

6. The method of claim 1, wherein the laser shocked area comprises a central area measuring 24 mm×18 mm.

7. The method of claim 6, wherein the laser has a pulse width 10 ns, a frequency 5 Hz, a pulse energy 6 J, the spot shape is square, and the spot size a is 6 mm.

8. The method of claim 1, wherein the lattice absorbing layer has a size of 24 mm×18 mm (mesh number 4×3) and includes a single absorption layer grid having a length of 6 mm, a 24 mm×18 mm (mesh number 8×6) grid absorbing layer, and a single absorbing layer grid length of 3 mm.

9. The method of claim 1, including the steps of mounting the metallic article on a five-axis workbench and forming the latticed absorbing layer onto the surface of the metallic article, using the running water as confinement layer.

10. The method of claim 1, wherein the laser beam has a starting position, and a point on the corner of single grid angle of the grid absorbing layer has a coincidence point at A and along an X- and Y-axis of the lattice absorbing layer.

11. The method of claim 1, wherein the laser spots have a spot size of 3 mm.

12. The method of claim 1, further including the steps of:

(11) removing the grid absorbing layer induced by LSP, leaving a surface of metallic article covered by a new absorbing layer of 24 mm×18 mm (grid number 8×6) mesh, having a starting position of the impact spot located at B point, which has deviation for a/3 from point A in a X- and Y-direction, and along the X- and Y-axis of the absorbing layer precise positioning; and

(12) progressively processing a surface of the second layer of metallic article by laser shock peening, until the machined area completed, has a 27 mm×21 mm (spot number 9×7) second layer of laser shock peened region, using a single laser beam length of 3 mm.

13. The method of claim 1, further comprising the steps of:

(13) removing the grid absorbing layer induced by LSP, leaving a surface of metallic article covered by a new absorbing layer of 24 mm×18 mm (grid number 8×6) mesh, having a starting position of the laser shock peened spot located at C point, having from point B to X- and Y-direction on the outward migration a/3, and along t the X- and Y-axis of the absorbing layer precise positioning; and

(14) progressively processing a surface of the third layer of metallic article with laser shock peening, until the machined area completed, has a 30 mm×24 mm (spot number 10×8) third layer of laser shock peened region, using single laser beam length of 3 mm.

14. The method of claim 1, wherein the surface of the material has the same parameters as the single point by point laser shock mode, effectively eliminating a spot boundary effect, wherein the surface roughness has even consistency, a surface roughness (Rz) of about 2.6, and a grain size of about 3-5 um after refinement.

* * * * *